US008087096B2

(12) United States Patent
Klein et al.

(10) Patent No.: US 8,087,096 B2
(45) Date of Patent: Jan. 3, 2012

(54) SLIP RESISTANT MULTI-LAYERED ARTICLES

(75) Inventors: Jeffrey A. Klein, Wilmington, DE (US); Michael J. Napolitano, Newark, DE (US); Kristy L. Vonk, Newark, DE (US); Mark Alan Williams, Landenberg, PA (US)

(73) Assignee: Gore Enterprise Holdings, Inc., Newark, DE (US)

( * ) Notice: Subject to any disclaimer, the term of this patent is extended or adjusted under 35 U.S.C. 154(b) by 418 days.

(21) Appl. No.: 11/037,749

(22) Filed: Jan. 18, 2005

(65) Prior Publication Data

US 2006/0156451 A1 Jul. 20, 2006

(51) Int. Cl.
*A41D 19/00* (2006.01)

(52) U.S. Cl. ..... 2/161.6

(58) Field of Classification Search ..... 2/16, 20, 2/161.1, 163, 161.6
See application file for complete search history.

(56) References Cited

U.S. PATENT DOCUMENTS

| | | | | | |
|---|---|---|---|---|---|
| 3,114,915 | A | * | 12/1963 | Gross | 2/158 |
| 3,953,566 | A | | 4/1976 | Gore | 264/288 |
| 3,962,153 | A | | 6/1976 | Gore | 260/2.5 R |
| 4,096,227 | A | | 6/1978 | Gore | 264/210 S |
| 4,187,390 | A | | 2/1980 | Gore | 174/102 R |
| 4,814,412 | A | | 3/1989 | Crowther et al. | 528/28 |
| 4,959,881 | A | * | 10/1990 | Murray | 15/227 |
| 5,123,119 | A | | 6/1992 | Dube | 2/168 |
| 5,244,716 | A | | 9/1993 | Thornton et al. | 428/198 |
| 5,302,440 | A | | 4/1994 | Davis | 428/196 |
| 5,328,449 | A | * | 7/1994 | Andrews et al. | 602/42 |
| 5,442,818 | A | | 8/1995 | Loos | 2/272 |
| 5,511,248 | A | | 4/1996 | Widdemer | 2/161.3 |
| 5,560,974 | A | * | 10/1996 | Langley | 428/198 |
| 5,740,551 | A | * | 4/1998 | Walker | 2/16 |
| 5,822,795 | A | | 10/1998 | Gold | 2/159 |
| 5,946,727 | A | * | 9/1999 | Wright et al. | 2/161.7 |
| 5,948,707 | A | | 9/1999 | Crawley et al. | 442/101 |
| 6,036,811 | A | * | 3/2000 | McGraw | 156/251 |
| 6,495,612 | B1 | | 12/2002 | Corzani et al. | 523/105 |
| 6,539,552 | B1 | | 4/2003 | Yoshida | 2/161.6 |
| 2004/0086684 | A1 | * | 5/2004 | Suzuki et al. | 428/98 |
| 2004/0098786 | A1 | * | 5/2004 | Hottner et al. | 2/159 |

FOREIGN PATENT DOCUMENTS

| | | |
|---|---|---|
| DE | 199 41 468 | 5/2001 |
| WO | WO 92/07480 | 5/1992 |

* cited by examiner

*Primary Examiner* — Katherine Moran
(74) *Attorney, Agent, or Firm* — Amy L. Miller

(57) ABSTRACT

Multiple-layered articles are provided which do not suffer from interlayer slippage upon application of a normal force and which are flexible and particularly well suited for use as dexterous hand coverings.

13 Claims, 3 Drawing Sheets

SLIP RESISTANT MULTI-LAYERED ARTICLES

FIELD OF THE INVENTION

The present invention relates to multi-layered articles with a slip resistant material interposed between the layers to reduce interlayer slippage.

BACKGROUND OF THE INVENTION

Many articles of apparel employ multiple layers, which serve various functions. For instance, multiple layers are often used in clothing including extremity coverings such as hand coverings and foot coverings. Multiple layers when assembled together serve a greater function than would be achieved by any one of the layers alone. Common types of layers include an outer layer, often referred to as a shell layer, and inner layers including linings, insulation, cushioning, or protective barrier films. Often multiple inner layers of various types may be employed.

A significant drawback to the use of multiple layers is their tendency to slide against one another during use. For example, when a wearer of a multi-layer glove is firmly gripping an object with the full hand, only the exterior portion of the shell layer is in contact with the object. In gloves comprised of multiple layers, a gripping motion causes some relative motion between the layers. This slippage results in an undesirable feeling and a lack of firm control on the object. The fine control desired in the fingers and fingertips is compromised if the layers are allowed to slip relative to one another. In many applications, fine finger dexterity is critical to performing necessary tasks, including the use of tools, personal electronic equipment, weapons or the manipulation of small objects. Interlayer slippage of handcoverings such as gloves results in the undesirable situation in which a user must choose between wearing gloves and performing tasks poorly, or removing gloves to perform tasks, in which case the user loses the protective value of the glove.

An additional drawback of allowing interlayer slippage is the occurrence of substantial abrasion between the layers, which can damage the layers. This abrasion damage can compromise the intended performance of the glove, negatively impact the durability of the glove and reduce the useful life.

One common solution to prevent interlayer slippage is the use of an adhesive to bond layers together. While this adhesive bond does eliminate slippage between layers, the resulting bonded composite exhibits greatly increased stiffness. This increased stiffness negatively affects glove dexterity, and results in increased hand fatigue. Furthermore, the bonding points between layers can become stress concentration points during use. Significant shear forces during bending can pull against those bonding points as the layers attempt to slide relative to one another. These stress concentration points can result in the bonding points pulling apart and potentially damaging the glove. This can be particularly detrimental to performance where protective films are employed within the glove. Damage to these films can greatly degrade the glove performance.

Enhanced anti-slip features are desirable in articles; for instance, U.S. Pat. No. 5,442,818 describes an inner lining structure in which a semi-permeable membrane layer and a textile material layer are joined in a slip-proof and semi-permeable manner. The joining of various layers to one another results in a certain stiffening and hence in an increase in dimensional stability, which is advantageous for certain applications as a lining. U.S. Pat. No. 5,948,707 describes a waterproof, water vapor permeable fabric laminate material which has non-slip properties. The material comprises a waterproof, water vapor permeable film or membrane laminated to a layer of fabric, wherein a discontinuous coating of elastomeric material provides non-slip properties by substantially increasing the coefficient of friction of the film or membrane side, which is generally the side facing the wearer. U.S. Pat. No. 5,302,440 describes polymeric coatings for contact surfaces such as handle grips, and methods of coating such surfaces. The coating can be applied to the contact surface in either a continuous or discontinuous manner. U.S. Pat. No. 5,511,248 describes an anti-slip glove which utilizes a thermoplastic polyurethane film panel incorporated onto the exterior of a glove design at key pressure points. The anti-slip panel may be attached separately to the palm and fingers of the glove or made an integral part of the hand-held sporting equipment. U.S. Pat. No. 5,244,716 describes a composite extensible material comprising a first film layer resistant to penetration by liquid water but permeable to water vapor adhered at discrete securing locations to a second layer of water vapor permeable extensible sheet material. The adherence between the two layers is such that the when the composite material is under zero stretching load and resting on a flat surface the second layer is substantially flat and the first layer is puckered.

However, it is only the present invention which addresses and fulfills the long-felt need of providing multiple layer articles which do not suffer from interlayer slippage and which are flexible and particularly well suited for use as a dexterous hand covering. It is a further advantage that the articles of the present invention do not suffer from reduced durability due to stress concentrations or interlayer abrasion.

SUMMARY OF THE INVENTION

An object of the present invention is to provide flexible articles comprising at least two layers with a slip resistant composition interposed between the at least two layers. The slip resistant composition reduces interlayer slippage and forms a flexible article with an added stiffness of less than 450 percent when compared to the stiffness of only the at least two layers.

Another object of the present invention is to provide flexible article comprising at least two layers with a slip resistant composition interposed between the at least two layers to reduce interlayer slippage and form a flexible article with total stiffness of less than 860 grams.

A yet further object of the present invention is to provide a flexible article in the form of a waterproof glove comprised of an exterior shell layer, a waterproof inner layer, with a slip resistant composition interposed between said layers. The addition of the slip resistant composition adds a stiffness of less than 450 percent to the exterior shell layer, and the waterproof inner layer.

DETAILED DESCRIPTION OF THE INVENTION

The present invention provides flexible articles with at least two layers, namely an outer or exterior shell layer and at least one inner layer, wherein a slip resistant composition is interposed between the layers. By interposed it is meant that the slip resistant composition is placed between layers in either an adhered or non-adhered manner. A flexible article of the present invention may be shaped to any desired form including but not limited to extremity coverings, gloves, glove systems, hand coverings, foot coverings, shoes, outerwear, coats, jackets, shirts, pants, hats, and any other suitable articles. The flexible articles of the present invention allow virtually unrestricted relative movement between the layers of an article when the article is not subjected to a normal force, and reduce interlayer slippage during the application of a normal force.

Figure 1:
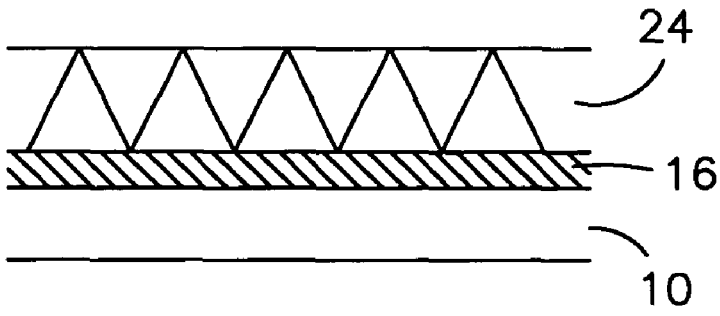
FIG. 1 shows a cross section of a slip resistant composition in contact with an exterior shell layer.

FIG. 1 shows an enlarged perspective view depicting a cross section of a slip resistant composition in contact with an exterior shell layer 10. In this figure a pressure sensitive adhesive (PSA) 16 was used to adhere the slip resistant composition to the exterior shell material. The slip resistant composition 24 reduces interlayer slippage of the layers. A slip-resistant composition is any composition which may be interposed between layers of a multi-layer article and which prevents slippage between the layers up to a shear force of 55 g/cm$^2$ upon application of a normal force, as determined by the parameters of the Static Frictional Force Test defined below. For the purposes of the present invention the results of static frictional forces are determined between a representative article layer material and ePTFE, using the Static Frictional Force Test.

The slip resistant composition may be interposed either adhesively or non-adhesively.

The exterior shell layer in accordance with the present invention may comprise either a single layer of leather, fabric, textiles or a laminate layer. Textile layers include but are not limited to woven materials, knit materials, or non-woven materials, materials employing synthetic fibers, natural fibers, or blends of synthetic and natural fibers. Laminate layers may be comprised of multiple materials including but not limited to at least one textile layer. A laminate layer may comprise a film or membrane, preferably ePTFE. As used herein, the term "ePTFE" is used to denote an expanded polytetrafluoroethylene typically in membrane form, that comprises a microporous structure of polytetrafluoroethylene (PTFE) in which there exists nodes of PTFE interconnected by fibrils of PTFE. The basic construction and properties of expanded PTFE are described in a number of references, including U.S. Pat. Nos. 3,953,566; 3,962,153; 4,096,227; and 4,187,390 all incorporated herewith by reference. The ePTFE films are inherently hydrophobic and resist entry and passage of liquid water while allowing passage of gases and water vapor through the films.

The slip resistant composition is preferably comprised of an elastomer. Suitable elastomers include but are not limited to polyether block amides, polyurethane foam, polyurethane films, silicones, polyurethanes, and polyvinyl chlorides. The slip resistant composition can be employed as dots, patches, discrete coatings, or hung layers between article layers. In a preferred embodiment, the elastomer is a plasticizer-free polyether block amide, such as those commercially available under the registered trademark PEBAX® sold by Arkema, Philadelphia, Pa.

In one embodiment, the flexible article of the present invention comprises at least two layers and a slip resistant composition interposed between the at least two layers. The slip resistant composition reduces interlayer slippage between the at least two layers and forms a flexible article with an added stiffness of less than 450 percent when compared to the stiffness of the at least two layers without the slip resistant composition.

In another embodiment, the flexible article of the present invention comprises at least two layers and a slip resistant composition interposed between the at least two layers to reduce interlayer slippage and forms a flexible article wherein the total stiffness of the slip resistant composition and the article layers is less than 860 grams.

Figure 2:
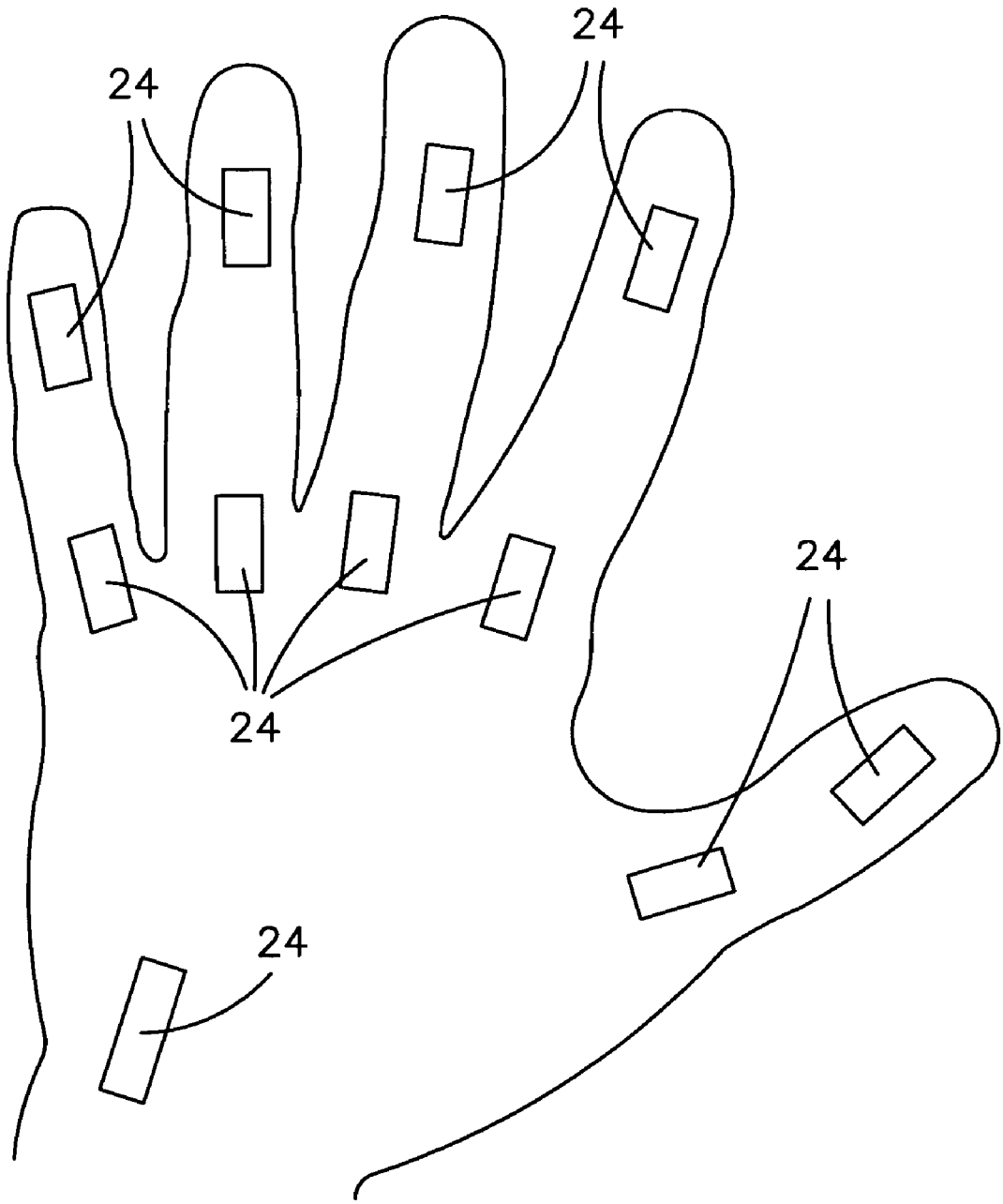
FIG. 2 shows a diagram of application locations for slip resistant compositions in a glove or glove insert.

FIG. 2 shows a diagram of application locations for slip resistant compositions on an exterior shell layer or alternatively on an inner layer of a glove. The slip resistant composition of the present invention restricts interlayer slippage that occurs when the layers are pressed together during use of an article, and allows dexterity and tactility preservation. Dexterity refers to the ability to perform a difficult action quickly and skillfully with the hands, or to facilitate quickness in manipulation. Dexterous gloves provide the ability to perform a difficult action without the need to remove the gloves. In contrast, "tactility" refers to the capability to be felt or touched and the responsiveness to stimulation of the sense of touch. For instance, tactile gloves allow fingertip sensation and control.

As is evident by the FIG. 2, it is desirable that a slip resistant composition 24 be adhered in discrete locations, where it is likely that at least a normal gripping force is applied so that interlayer slippage is avoided. Slippage occurs when a shear force applied is greater than the static friction force between the material layers as measured by The Static Frictional Force test, set forth hereinafter. The slip resistant composition of this invention will prevent interlayer slippage up to a shear force of 55 g/cm$^2$, and preferably up to a shear force of 83 g/cm$^2$ using the Static Frictional Force Test defined hereinafter. In the absence of a normal force during gripping, layers are able to slide between one another at a shear force of greater than or equal to 0.8 g/cm$^2$ as shown in Example 4 using the Static Frictional Force Test and a normal force of 0.1 g/cm$^2$.

When a slip resistant composition is used in an article it is preferred that a minimal amount of additional stiffness is incurred in the article. The Stiffness Test defined hereinafter was used to determine the stiffness of the layered ensembles as shown in Examples 5 and 6. Stiffness of the layers is increased by varying amounts related to the types of slip resistant composition used between the layers. It is desirable for the slip resistant composition to be as thin as possible so as not to introduce bulk into the article. While it is preferable that the slip resistant composition is less than 3.18 mm thick, it is further preferred that the slip resistant composition is less than 1 mm thick.

The multiple layers used in the articles of this invention may be comprised of a variety of materials to serve a variety of purposes. In many applications, the insert layer is a film employed to achieve waterproof protection. Various types of polymer films can also be employed for this purpose, including but not limited to: ePTFE, polyolefins, latexes, natural rubber, polyisoprenes, nitriles, polyurethanes, acrylics, polymethyl methacrylates and polyester films. In one preferred embodiment the insert layer is a waterproof breathable film comprising a microporous polymer layer and a thermoplastic polymer layer.

For purposes of defining the present invention, the static frictional forces between representative layer materials and ePTFE are measured using the Static Frictional Force Test defined hereinafter. Due to the low coefficient of friction of ePTFE, it is chosen as a good substrate to use as a control for comparing the frictional properties of other materials. The static frictional force between ePTFE and any other material is expected to be low due to the properties of ePTFE. A material that exhibits a static frictional force with ePTFE of greater than or equal to 55 g/cm$^2$ is deemed to effectively reduce interlayer slippage between typical glove layers. Materials that exhibit a static frictional force with ePTFE of less than 55 g/cm$^2$ are deemed to exhibit unacceptable interlayer slippage. It is preferred that the static frictional force between a material and ePTFE be greater than 83 g/cm$^2$.

While FIG. 2 shows locations for placement of a slip resistant composition on a glove layer, FIGS. 3A through 3D show cross sectional layer configurations of a slip resistant composition interposed between layers. Multi-layered articles comprise at least two layers, namely an exterior shell layer 10 and at least one inner layer 14. The exterior shell layer may comprise textiles, leathers, synthetic leathers, laminates or any other suitable materials. The inner layer may comprise a barrier, a waterproof breathable film, laminates, or textile layers. The exterior shell layer 10 has an exterior side of the exterior shell layer 11 and an interior side of the exterior shell layer 12. The interior side of the exterior shell layer 12 contacts an inner layer of a layered article, in this drawing the inner layer is an insert layer. Multiple inner layers may be present in a layered article, such as a barrier or insert layer 44, a lining layer 36, and/or an insulation layer (not shown). The term "insert" refers to a seamed or non-seamed article which provides the user with the barrier protection. For instance, an insert can maintain or allow qualities to exist in an article such as but not limited to: waterproofness, breathability, prevention of toxic contamination, prevention of nontoxic fluids from contaminating the skin, or other desired characteristics. An example of an insert is a glove layer, which is placed between the outer shell and a wearer's hand to provide protection to the wearer's hand.

The insert layer may comprise a waterproof barrier material. The insert may be one layer or a multiple layered construction. When present in a layered article, the insert layer 44 has an interior side of the insert layer 45 and an exterior side of the insert layer 43. The interior side of the insert layer 45 is the side in closest proximity to the user or wearer of an article. An interior lining 36 has an interior side of interior lining 37 and an exterior side of the interior lining 38. The interior side of interior lining layer 37 is the side in closest proximity with the wearer of an article. The interior lining layer 36 may comprise a multiple layer composite and can include an optional insulation. The insulation may or may not be adhered to other materials in the interior lining layer.

Figure 3D:
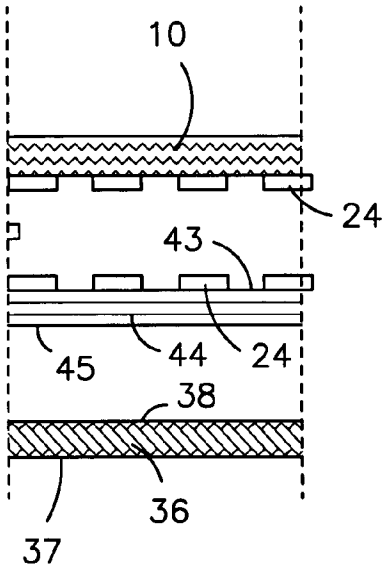
FIGS. 3A through 3D show cross sections of layer configurations with slip resistant composition interposed between layers.
Figure 3C:
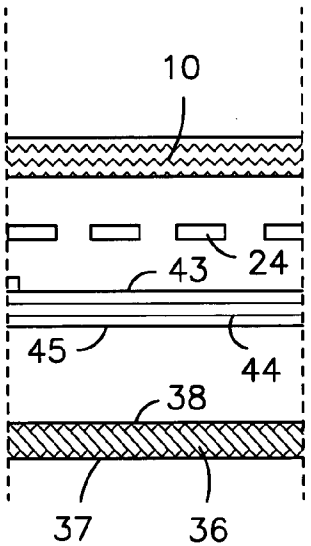
Figure 3B:
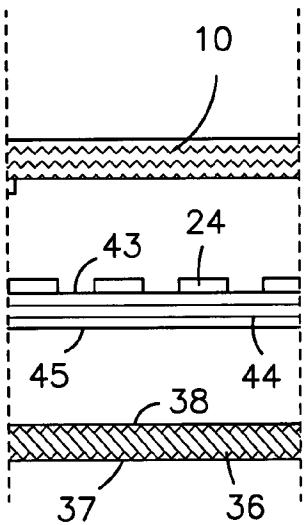
Figure 3A:
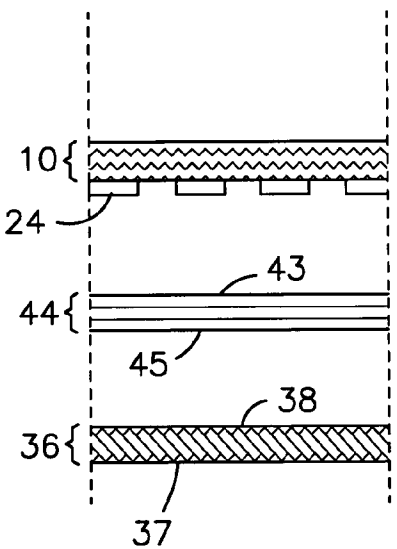

The slip resistant composition 24 may be interposed between the layers of an article in various configurations. For example, a slip resistant composition 24 may be adhered on at least one side to the interior side of the exterior shell layer 10, as shown in FIG. 3A. A slip resistant composition 24 may be adhered to the exterior side of the insert layer 44 so that the non-adhered side of the slip resistant composition 24 contacts the opposing surface of the article layer upon application of pressure, as shown in FIG. 3B. As shown in FIG. 3C, a slip resistant composition 24 may be interposed between the insert layer 44 of an article and the exterior side of the interior lining of an article in the same manner. FIG. 3D shows a slip resistant composition 24 adhered to two matingly opposed layer surfaces so that the slip resistant composition 24 adhered to the exterior surface of one layer comes into contact with a slip resistant composition 24 on the interior surface of an adjacent layer upon application of a pressure. While the slip resistant composition 24 has been described in FIGS. 3A, 3B and 3D as being adhered to at least one surface of a multi-layered article it is important to note that the slip resistant composition 24 may be present as a non-adhered or "hung-liner" fashion between article layers. As shown in FIGS. 3A-3D, in multi-layer articles comprising more than two layers, the slip resistant composition 24 may be attached to any or all of the layers to prevent interlayer slipping of one layer in relation to the others. Alternatively, the slip resistant composition 24 may be interposed between article layers as an unattached individual slip resistant composition layer to prevent interlayer slipping of one article layer in relation to another article layer. Numerous variations exist for the placement of a slip resistant composition 24 as defined by the present invention, and all such variations while not explicitly described herein are nonetheless intended to be included within the scope of the present invention.

The present invention may be fashioned into the form of a waterproof glove comprised of an exterior shell layer 10, an insert layer 44 comprising a waterproof breathable film and an interior lining layer 36 comprising a textile. In this embodiment, strips of a slip resistant composition 24 comprising a plasticizer-free thermoplastic elastomer are attached to the interior surface of the exterior shell layer 10 and attached to the exterior side of the interior lining layer 38 at discrete locations using an adhesive. Suitable adhesives to attach the slip resistant composition to the interior surface of the exterior shell layer include pressure sensitive adhesives or any other suitable adhesive or fastening means. The waterproof layer is preferably breathable. The term "breathable" refers to materials having a Moisture Vapor Transmission Rate (MVTR) of at least about 1,000 (grams/(m2)(24 hours)). In preferred embodiments the waterproof glove comprises a slip resistant composition which has a thickness of less than 3.18 millimeters, and further preferred which has a thickness of less than 1 millimeter. It is preferable that the slip resistant composition covers less than 50%, preferably less than 25% of the total surface area on the proximal or palm side of the glove. This is particularly desired in the case of breathable hand coverings, where occlusion of the entire proximal area with a slip resistant composition exhibiting lower MVTR results than the individual exterior shell layer and inner layers would be detrimental to performance.

Additionally, insert layers may be used when articles require chemical protection, and may employ various protective materials including a variety of permeation-resistant materials, such as ethylene vinyl alcohol, polyvinylidene chloride, poly(ethylene-chlorotrifluoroethylene), high-density polyethylene, polypropylene, or polyethylene terephthalate, or laminates comprising adsorptive compounds such as activated carbon or other suitable materials for desired applications. Preferred protective films are comprised of polytetrafluoroethylene (PTFE), and more preferably comprised of expanded polytetrafluoroethylene (ePTFE). The most preferable polymer films are waterproof and breathable.

The characteristics and qualities of the materials used in the present invention have been evaluated using the test methods described below, except when otherwise indicated.

Water Vapor Transmission of Materials (MVTR) Test

ASTM test method E96 entitled "Test Methods for Water Vapor Transmission of Materials" was used to measure the breathability of the materials. Specifically, the inverted cup method was used with a free stream air velocity of 550±50 feet per minute (fpm) as measured 2 inches above the specimen. The air flow was measured at least 2 inches from any other surface. The test was conducted for 2 hours, and the resulting weight measurements were taken at only the start and completion of the test.

Waterproofness Test

ASTM method D751 Procedure B describes the test used for waterproofness. In this test, the sample was restrained, a fixed hydrostatic head of 0.7 lbs/in$^2$ minimum applied and held for 3 minutes minimum. A passing result is no leakage after 3 minutes where leakage is defined as the appearance of one or more droplets anywhere within the test area.

Waterproofness is determined by conducting waterproof testing as follows: materials or composites (or seamed flat materials or composites) are tested for waterproofness by using a modified Suter test apparatus, which is a low water entry pressure challenge. Water is forced against a sample area about 4.25 inches in diameter and sealed by two rubber gaskets in a clamped arrangement. The sample is open to atmospheric conditions and is visible to the operator. The water pressure on the sample is increased to about 1 psi by a pump connected to a water reservoir, as indicated by an appropriate gauge and regulated by an in-line valve. The test sample is at an angle and the water is recirculated to assure water contact and not air against the sample's lower surface. The upper surface of the sample is visually observed for a period of 3 minutes for the appearance of any water forced through the sample. Liquid water seen on the surface is interpreted as a leak. A passing or waterproof grade is given for no liquid water visible within 3 minutes. Passing this test is the definition of "waterproof" as used herein.

The Static Frictional Force Test

ASTM test method D 1894-01 entitled "Standard Test Method for Static and Kinetic Coefficient of Friction of Plastic Film and Sheeting" is incorporated by reference herein and was used to measure the static frictional force between materials. ASTM test method D 1894-01 is referred to herein as "The Static Frictional Force Test" for measuring slip resistance.

Specifically, Method A was employed, using a constant-speed chain drive system, as denoted in FIG. 1(*a*) of the standard. Unless noted otherwise, a weight was applied to the top of the sled to increase the normal force to 61 g/cm$^2$ during the test. A normal force of 61 g/cm$^2$ is chosen to represent the force exerted when gripping an object. The value was obtained from data in "Using Force Sensitive Resistors to Evaluate Hand Tool Grip Design" by Myung Hwan Yun, Kentaro Kotani, and Darin Ellis of Pennsylvania State University, as reported in *Proceedings of the Human Factors Society* 36$^{th}$ *Annual Meeting*—1992. Where noted, the sled was replaced with a 4 gram aluminum sheet of equivalent length and width as the original sled, thereby applying a normal force of 0.1 g/cm$^2$. A normal force of 0.1 g/cm$^2$ is representative of the absence of a gripping force. The static frictional force reported is the product of the static coefficient of friction and the normal force. The average of at least three tests are reported for each material combination.

The Stiffness Test

ASTM test method D6828 entitled "Standard Test Method for Stiffness of Fabric by the Blade/Slot Method", is incorporated by reference herein and was used to measure the stiffness of the layered ensembles. ASTM test method D6828 is referred to herein as "The Stiffness Test". This method involves laying a flat 4" by 4" material across a specified gap or slot and then pressing a blade onto the material to force it to move through the gap.

For the purposes of describing the present invention, the following test parameters have been used, unless other wise noted. The slot width is maintained at 0.25 inches (except that the slot width is changed for example #6). For composites where the total stiffness was less than 400, a 100-gram beam was used. For composites where the total stiffness was greater than 400, a 1000 gram beam was used. The instrument used was a Thwing-Albert Instrument Company model #211-5-10. Four individual measurements are taken for each composite, and the total stiffness of the four measurements is reported in grams. One skilled in the art could foresee numerous variations not explicitly detailed, but embodied by the teachings disclosed herein. The following examples are intended to further illustrate but not limit the present invention.

EXAMPLES

Example 1

The slip resistant composition tested in this example was PEBAX® resin, a product of Arkema, Philadelphia, Pa. (formerly Atofina Chemicals). An extruded sheet of PEBAX® 2533 was tested and found to have a thickness of approximately 0.0254 mm. An acrylic pressure sensitive adhesive (PSA), with a thickness of approximately 0.152 mm was pressed together with the PEBAX® 2533 and slit into strips of approximately 22.2 mm wide. These strips were cut to approximately 25 millimeters in length. The PSA side of these pieces was applied to the interior side of a goatskin leather glove shell at discrete locations, resulting in the PEBAX® side of the pieces facing away from the exterior surface of the leather shell.

A waterproof and breathable glove insert commercially available from W.L. Gore & Associates as part number 346469 was used. The PEBAX® layers attached to both the shell and liner materials were oriented towards the nonwoven layers of the waterproof, breathable insert. The waterproof, breathable glove insert was attached to the shell and liner with tabs of adhesive tape.

A cross section of a typical layering ensemble of a multilayer glove system is shown in FIG. 3. As shown in the table below, the incorporation of PEBAX® between the leather and nonwoven layer of the waterproof and breathable insert increases the static frictional force between the two layers from 46 g/cm$^2$ to 85 g/cm$^2$ using the Static Frictional Force Test defined herein. This increase of static frictional force from 46 g/cm$^2$ to 85 g/cm$^2$ was deemed to effectively reduce interlayer slippage, thereby resulting in a glove construction that allows excellent grip and dexterity.

TABLE 1

| First Layer | Second Layer | Static Frictional Force (g/cm$^2$) |
|---|---|---|
| Leather | Nonwoven | 46 |
| PEBAX ® film | Nonwoven | 85 |

Example 2

Same as Example 1 except that PEBAX® material is adhered to the outer surface of the waterproof breathable insert layer using pressure sensitive adhesive. As seen in the table below, the static frictional force then increased from 46 g/cm$^2$ to 52 g/cm$^2$ using the Static Frictional Force test.

TABLE 2

| First Layer | Second Layer | Static Frictional Force (g/cm$^2$) |
|---|---|---|
| Leather | Nonwoven | 46 |
| Leather | PEBAX ® film | 52 |

This increase of static frictional force from 46 g/cm$^2$ to 52 g/cm$^2$, while small, was deemed to significantly reduce interlayer slippage, resulting in a glove construction that allows excellent grip and dexterity.

Example 3

Same as Example 1 except that PEBAX® is not backed with PSA, and is hung between layers. This provides the same frictional force between PEBAX® and shell materials as given in Example 2, and the same frictional force between PEBAX® and protective film materials as given in Example 1.

Example 4

The use of adhesive to bond layers together over their entire surface is a known practice for gloves. While this adhesion alleviates the slippage between layers during gripping, the bonded layers create a composite with far greater stiffness than the same layers in a non-bonded state. This stiffness is due to the inability of the bonded layers to slide against one another when the composite is bent during flexing. Therefore, the layers must all bend together, resulting in a composite bending force that is greater than the sum of the bending forces of the individual layers.

To evaluate this stiffness of bonded layers, pressure sensitive adhesives were used to bond composite layers together. The adhesives used are available commercially from 3M Corporation (St. Paul, Minn.) and were chosen due to their low inherent stiffness. It is therefore expected that most adhesives would increase composite stiffness even more than the adhesives used in this example. The static frictional force values of these layered composites was determined using the Static Frictional Force Test, except that the sled was replaced with a 4 gram aluminum sheet with dimensions of 2.5 inches by 2.5 inches. Before testing for static frictional force, a weight was applied to the aluminum sheet to exert a normal force of 61 g/cm$^2$. This weight was then removed, so that the normal force during the test was 0.1 g/cm$^2$. This procedure was done as a pre-conditioning step to simulate one prior gripping force exerted and released on the layered composite. The static frictional force was then determined using the Static Frictional Force Test, using a normal force of 0.1 g/cm$^2$ to simulate whether layers could slide when not gripping in the glove. These results are shown below:

TABLE 3

| First Layer | Second Layer | Normal Force (g/cm$^2$) | Force (g/cm$^2$) Required to Move Sled |
|---|---|---|---|
| PEBAX ® film | EPTFE | 0.1 | 0.8 |
| 3M 950 adhesive | EPTFE | 0.1 | 188.1 |
| 3M 965 adhesive | EPTFE | 0.1 | 152.9 |
| Acrylic PSA adhesive | EPTFE | 0.1 | 119.5 |

The resistance to slip for the adhesively bonded ensembles is still high without a normal force applied, in fact even higher than the PEBAX® material in the presence of a normal force.

Example 5

TABLE 4

| Test # | Layer #1 | Slip Resistant Material | Layer #2 | Stiffness | % Increase in Stiffness (Over Composite Without Slip Resistant Material) |
|---|---|---|---|---|---|
| 1 | Woven nylon | None | 3-layer nonwoven laminate | 351 | 100.0% |
| 2 | Woven nylon | PEBAX ® film | 3-layer nonwoven laminate | 363 | 103.4% |
| 3 | Woven nylon | PEBAX ® film attached to layer #1 with PSA | 3-layer nonwoven laminate | 597 | 170.1% |
| 4 | Woven nylon | PSA attaching layer #1 to layer #2 | 3-layer nonwoven laminate | 1274 | 363.0% |
| 5 | Woven nylon | None | Waterproof breathable film | 146 | 100.0% |
| 6 | Woven nylon | PEBAX ® film | Waterproof breathable film | 146 | 100.0% |
| 7 | Woven nylon | PEBAX ® film attached to layer #1 with PSA | Waterproof breathable film | 260 | 178.1% |
| 8 | Woven nylon | PSA attaching layer #1 to layer #2 | Waterproof breathable film | 329 | 225.3% |

This table shows a stiffness comparison using the Stiffness test defined herein for two-layered composites showing the disadvantage of bonding layers together to eliminate inter-layer slip. Samples 1 and 5 ensembles were control materials with no slip resistant material present between the layers. To compare the use of adhesive versus the use of the slip resistant composition of the present invention, a percentage increase in stiffness was calculated as the test material stiffness reading divided by the control material stiffness reading multiplied by a factor of 100 and reported as a percent.

The 3-layer nonwoven material used in test samples 1-4 comprised a material used in glove inserts from W.L. Gore & Associates, part number 346469. The waterproof breathable film used in test sample 5-8 comprised a material as described in U.S. Pat. No. 4,814,412. The woven nylon shell material used in test samples 1-8 is a commercially available plain woven nylon shell fabric weighing 2.9 oz/yd$^2$ from Milliken & Company, of Spartanburg, S.C.

The layered composites of test samples 2-3 and 6-7 used a slip resistant composition in accordance with the present invention, and resulted in an increase of stiffness of significantly less than composites using only PSA adhesives.

Example 6

Layered composites of glove materials were constructed and tested for composite stiffness. Layered composites were comprised of a shell material, an insert material, and an inner liner material. Shell materials included a 21.6 oz/yd$^2$ leather and a 2.8 oz/yd$^2$ nylon knit. For some layered composites, a slip-resistant composition was attached to the interior side of the shell material and the exterior side of the liner material.

This slip-resistant composition comprised a 0.0254 mm thick layer of PEBAX® 2533 attached to shell and liner materials using an acrylic pressure sensitive adhesive.

The various layered composites were tested using the Stiffness Test defined herein, except that a slot width of 10 mm was used, instead of 0.25 inches. The results of this testing are given below:

TABLE 5

| Test Number | Shell Material | Slip-resistant Material | Insert Material | Slip-resistant Material | Liner Material | Total Stiffness | % Increase Over Composite Without Slip-resistant Material |
|---|---|---|---|---|---|---|---|
| 1 | Knit | None | Waterproof breathable film | None | Knit | 29 | 100% |
| 2 | Knit | None | 3-layer nonwoven laminate | None | Knit | 113 | 100% |
| 3 | Knit | PEBAX ® film attached to layer#1 with PSA | Waterproof breathable film | PEBAX ® film attached to layer#3 with PSA | Knit | 128 | 441% |
| 4 | Knit | PEBAX ® film attached to layer#1 with PSA | 3-layer nonwoven laminate | PEBAX ® film attached to layer#3 with PSA | Knit | 275 | 243% |
| 5 | Leather | None | Waterproof breathable film | None | Knit | 369 | 100% |
| 6 | Leather | None | 3-layer nonwoven laminate | None | Knit | 597 | 100% |
| 7 | Leather | PEBAX ® film attached to layer#1 with PSA | Waterproof breathable film | PEBAX ® film attached to layer#1 with PSA | Knit | 579 | 157% |
| 8 | Leather | PEBAX ® film attached to layer#1 with PSA | 3-layer nonwoven laminate | PEBAX ® film attached to layer#1 with PSA | Knit | 859 | 144% |

To compare the use of adhesive versus the use of the slip resistant composition of the present invention, a percentage increase in stiffness was calculated as the test material stiffness reading divided by the control material stiffness reading multiplied by a factor of 100 and reported as a percent. From the table above, it is seen that a slip-resistant composition of the present invention maintained a total stiffness of less than 860 grams for a layered composite. Furthermore, the addition of a slip-resistant composition of the present invention to a layered ensemble did not increase the stiffness of the layered ensemble by more than 450 percent, as compared to the stiffness of the layered ensemble prior to interposing the slip-resistant composition.

Example 7

TABLE 6

| Test # | Material #1 | Material #2 | Static Frictional Force (g/cm2) |
|---|---|---|---|
| 1 | EPTFE | Taslite | 33.8 |
| 2 | EPTFE | Leather | 35.3 |
| 3 | EPTFE | PU Foam | 55.0 |
| 4 | EPTFE | PEBAX ® film | 83.1 |
| 5 | EPTFE | 3M 950 PSA | >900 |
| 6 | EPTFE | 3M 965 PSA | >1000 |
| 7 | EPTFE | Avery FT1126 PSA | >1000 |

Table 6, above, shows the static frictional forces between representative layer materials and ePTFE, using the Static Frictional Force Test defined hereinafter. For static frictional force results exceeding 900 g/cm$^2$, the actual values exceed the maximum value available per the measurement scale, as indicated by a break in the monofilament line when a normal force of 61 g/cm$^2$ was applied to the sled.

The static frictional force measurements in tests samples 3-7 resulted in static frictional forces of greater than or equal to 55 g/cm$^2$. Due to the low coefficient of friction of ePTFE, it was chosen to compare the frictional properties of other materials. A material that exhibits a static frictional force with ePTFE of greater than or equal to 55 g/cm$^2$ was deemed to effectively reduce interlayer slippage between typical glove layers. Materials that exhibit a static frictional force with ePTFE of less than 55 g/cm$^2$ were deemed to exhibit unacceptable interlayer slippage. It is preferred that the static frictional force between a material and ePTFE be greater than 83 g/cm$^2$.

While the principles of the invention have been made clear in the illustrative embodiments set forth above, it will be obvious to those skilled in the art to make various modifications to the structure, arrangement, proportion, elements, materials, and components used in the practice of the invention. To the extent these various modifications do not depart from the spirit and scope of the appended claims they are intended to be encompassed therein.

What is claimed is:

1. A flexible article comprising at least two layers and a slip resistant composition, said slip resistant composition comprising one non-adhered surface and one adhered surface using a pressure sensitive adhesive to attach the one adhered surface of the slip resistant composition to one of the at least two layers, said slip resistant composition further being interposed between the at least two layers to reduce interlayer slippage during application of a normal gripping force and form a flexible article comprising an added stiffness of less than 450 percent when compared to the stiffness of the at least two layers, wherein there is relative movement between said one non-adhered surface of the slip resistant composition and an adjacent layer of the at least two layers in the absence of a normal force, further wherein said non-adhered surface of the slip resistant composition is in communication with one of said at least two layers and said adhered surface of the slip resistant composition in communication with the other of the at least two layers.

2. A flexible article comprising at least two layers and a slip resistant composition, said slip resistant composition comprising non-adhered surface and one adhered surface using a pressure sensitive adhesive to attach the one adhered surface of the slip resistant composition to one of the at least two layers, said slip resistant composition further being interposed between the at least two layers to reduce interlayer slippage during application of a normal gripping force and form a flexible article comprising total stiffness of less than 860 grams, wherein there is relative movement between said one non-adhered surface of the slip resistant composition and an adjacent layer of the at least two layers in the absence of a normal force, further wherein said non-adhered surface of the slip resistant composition is in communication with one of said at least two layers and said adhered surface of the slip resistant composition in communication with the other of the at least two layers.

3. The flexible article of claim 1 or 2 wherein the article is a glove.

4. The flexible article of claim 1 or 2 wherein the slip resistant composition is discontinuous.

5. A waterproof glove comprised of an exterior shell layer, a breathable waterproof inner layer, and a slip resistant foam composition, comprising one adhered and one non-adhered surface, said slip resistant composition further being interposed between said layers to reduce interlayer slippage during application of a normal gripping force and which adds a stiffness of less than 450 percent to the exterior shell layer and the waterproof inner layer, wherein the exterior shell layer has relative movement with respect to the non-adhered surface of the slip resistant composition.

6. A waterproof glove comprised of an exterior shell layer, a breathable waterproof inner layer, and a slip resistant foam composition, comprising one adhered and one non-adhered surface, said slip resistant composition further being interposed between said layers to reduce interlayer slippage during application of a normal gripping force and which forms a flexible article wherein the exterior shell layer has relative movement with respect to the non-adhered surface of the slip resistant composition.

7. The waterproof and breathable glove of claim 5 or 6 wherein the slip resistant composition has a thickness of less than or equal to 3.18 millimeter.

8. The waterproof and breathable glove of claim 5 or 6 wherein the slip resistant composition has a thickness of less than 1 millimeter.

9. The waterproof and breathable glove of claim 5 or 6 wherein the slip resistant composition covers less than half of the proximal surface area of the glove.

10. The waterproof glove of claim 5 or 6 wherein the slip resistant composition is attached to the interior proximal side of outer shell.

11. The glove of claim 5 or 6 wherein the slip resistant composition is discontinuous.

12. A waterproof glove comprised of an exterior shell layer, a breathable waterproof inner layer, and a slip resistant plasticizer-free polyether block amide elastomer composition comprising one adhered and one non-adhered surface, said slip resistant composition further being interposed between said layers to reduce interlayer slippage during application of a normal gripping force and which adds a stiffness of less than 450 percent to the exterior shell layer and the waterproof inner layer, wherein the exterior shell layer has relative movement with respect to the non-adhered surface of the slip resistant composition.

13. A waterproof glove comprised of an exterior shell layer, a breathable waterproof inner layer, and a slip resistant plasticizer-free polyether block amide elastomer composition comprising one adhered and one non-adhered surface, said slip resistant composition further being interposed between said layers to reduce interlayer slippage during application of a normal gripping force and which forms a flexible article wherein the exterior shell layer has relative movement with respect to the non-adhered surface of the slip resistant composition.

* * * * *